US005490593A

United States Patent [19]

Gordon et al.

[11] Patent Number: 5,490,593

[45] Date of Patent: Feb. 13, 1996

[54] GLASS BOTTLE CARRIER WITH DIVIDER

[75] Inventors: Robert L. Gordon, Monroe; Linda A. Bernstein, Campbell Hall, both of N.Y.

[73] Assignee: International Paper Company, Purchase, N.Y.

[21] Appl. No.: 325,011

[22] Filed: Oct. 19, 1994

[51] Int. Cl.[6] ..... B65D 5/48

[52] U.S. Cl. ..... 206/157; 206/193

[58] Field of Search ..... 206/142, 143, 206/147, 148, 149, 151, 152, 153, 156, 157, 160, 193, 194, 196, 158

[56] References Cited

U.S. PATENT DOCUMENTS

| | | | |
|---|---|---|---|
| 2,523,986 | 9/1950 | Foster | 206/156 |
| 2,684,759 | 7/1954 | Freeman . | |
| 3,276,661 | 10/1966 | Wells . | |
| 3,454,156 | 7/1969 | Chatten . | |
| 3,554,402 | 1/1971 | Lock | 206/193 |
| 3,884,354 | 5/1975 | Guenther . | |
| 3,942,631 | 3/1976 | Sutherland . | |
| 4,406,365 | 9/1983 | Kulig | 206/194 X |
| 4,706,876 | 11/1987 | Wilson . | |
| 4,911,289 | 3/1990 | Bird . | |
| 5,002,186 | 3/1991 | Cooper . | |
| 5,065,937 | 11/1991 | Ritter | 206/193 X |
| 5,222,658 | 6/1993 | DeMaio . | |
| 5,267,644 | 12/1993 | Tsao | 206/194 X |
| 5,328,024 | 7/1994 | Sutherland . | |

*Primary Examiner*—Jacob K. Ackun
*Attorney, Agent, or Firm*—Michael J. Doyle

[57] ABSTRACT

A flat paperboard bottle carrier is provided with an integral and depending bottle divider panel which makes the carrier particularly useful for carrying glass bottles. The divider flap extends between adjacent pairs of glass bottles and prevents glass clinking sound or banging together of the glass bottles as they are carried by a consumer. The carrier is provided with a finger hole for insertion of the fingers for carrying the carrier, with the longitudinal axis of the finger hole lying in the plane of the divider. Three variations in form are disclosed.

7 Claims, 6 Drawing Sheets

FIG. 2
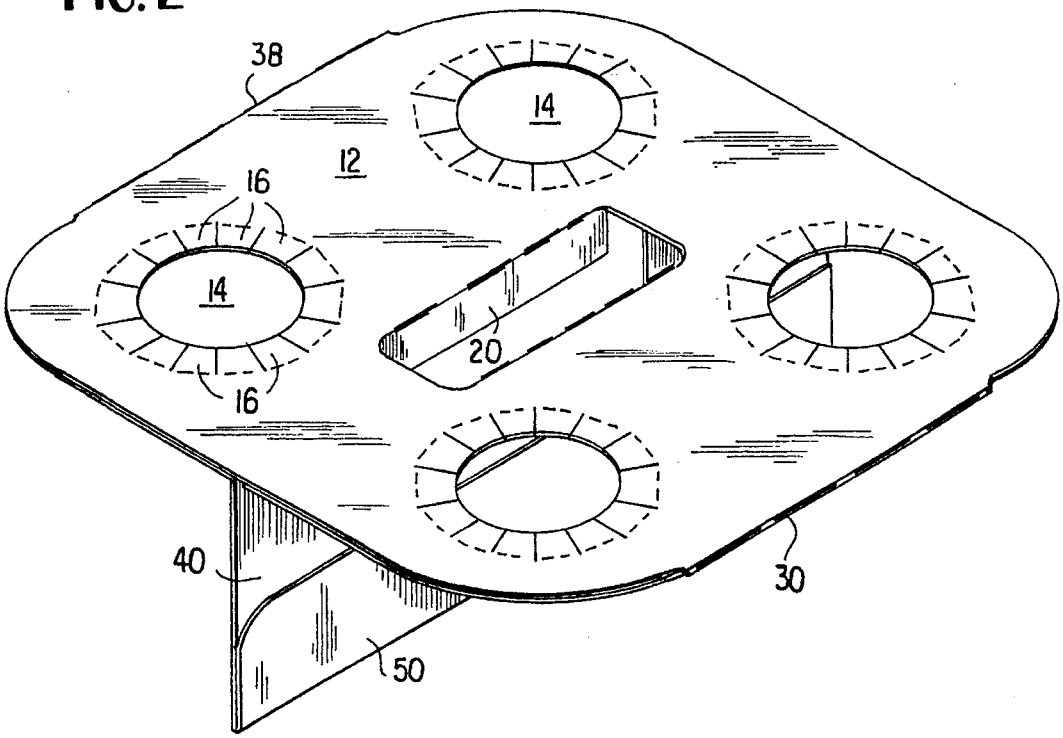
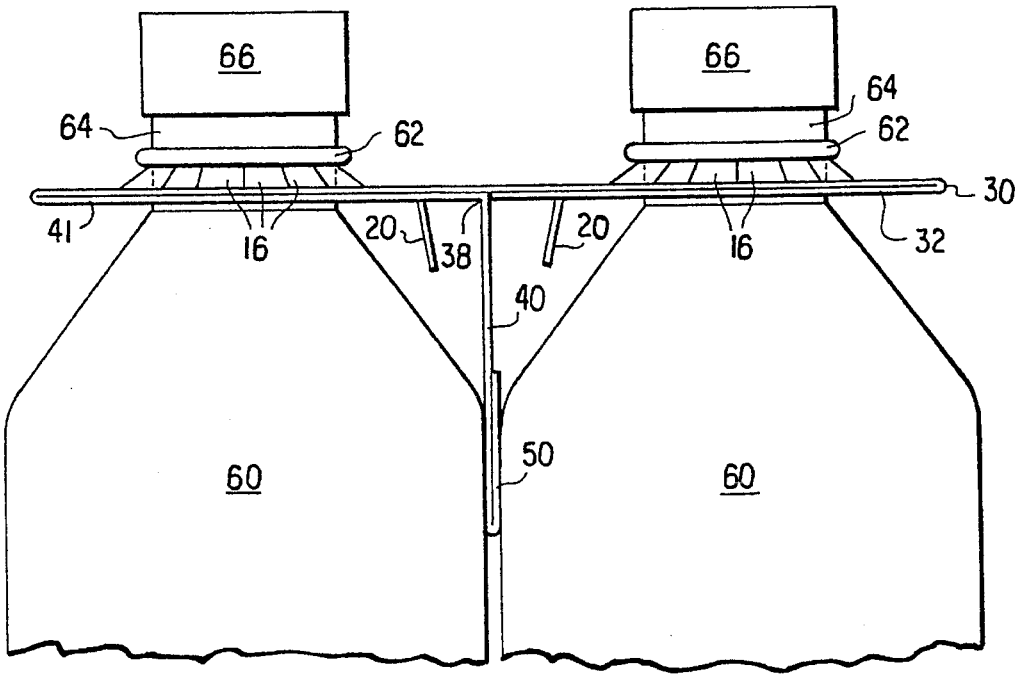
FIG. 3

FIG. 5
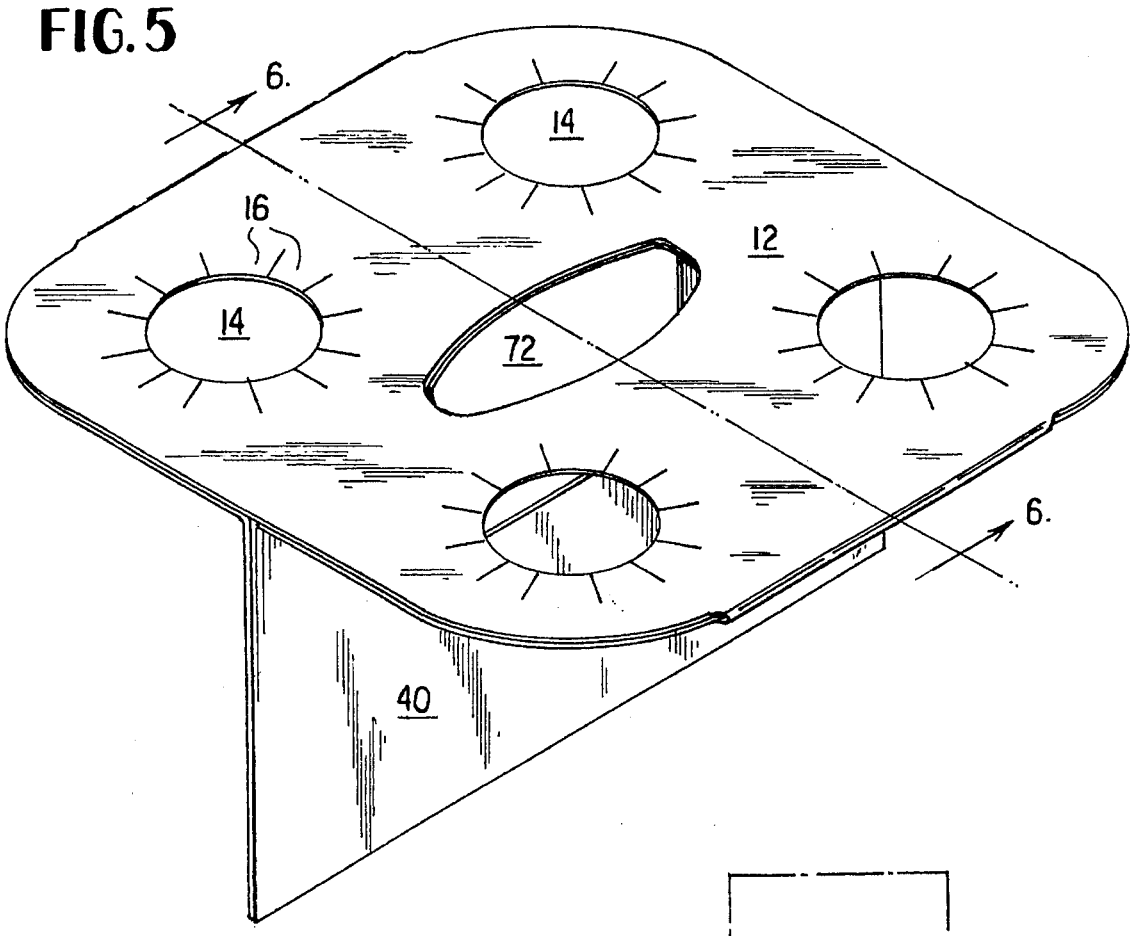
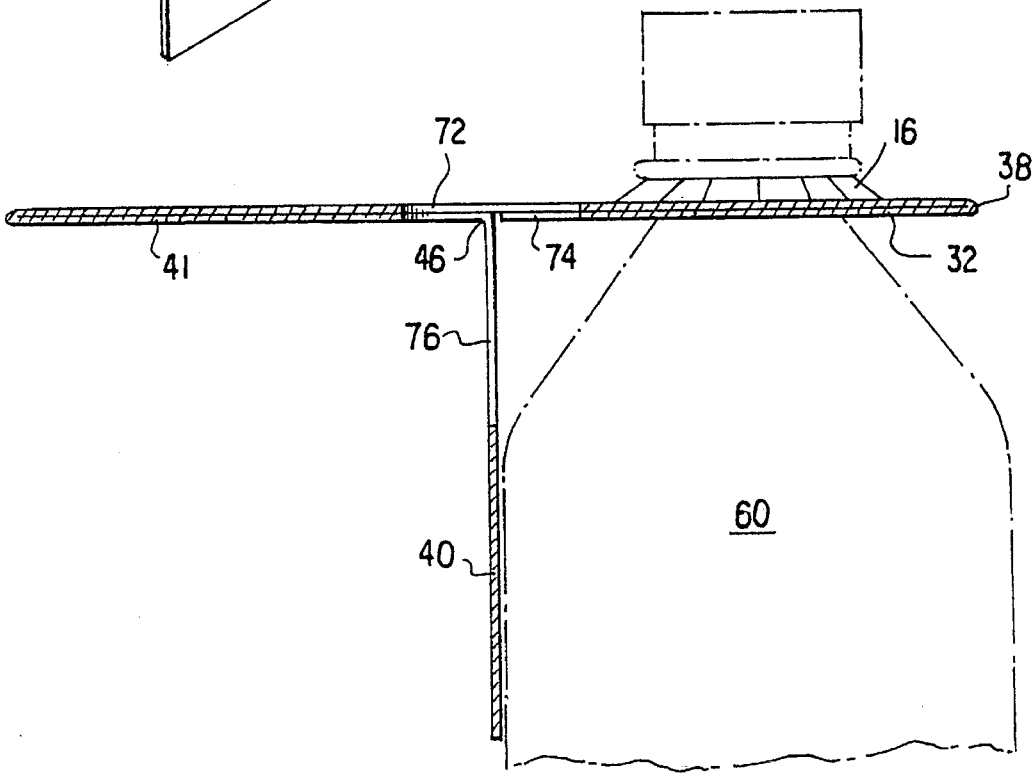
FIG. 6

GLASS BOTTLE CARRIER WITH DIVIDER

BACKGROUND OF THE INVENTION

This invention relates to a carrier particularly adapted for glass bottles containing soft drinks or the like. Relatively small liquid containers, such as metal cans and both glass and plastic bottles are packaged in flat, horizontal paperboard carriers, the paperboard often being reinforced by one or more folded layers, with the main panel of the carrier being provided with a plurality of bottle or can receiving openings. The periphery of each opening is defined by the free ends of tips of resilient fingers, the fingers engaging beneath the chime of a metal can, or in the case of a plastic or glass bottle, beneath the bottle cap or beneath an integral and annular abutment on the neck of the bottle. The carriers are moved downward relative to the cans or bottles and the tops of the latter extend through the openings. In the case of plastic or glass bottles, the extent of the relative movement between the tops of the bottles and the carrier is such that the resilient fingers of each of the openings extend upwardly about 45°–60° with respect to the plane of the carrier.

While serving to group and transport by the consumer a typical small group of glass bottles, such as four or six, the past constructions of this general type suffer the disadvantage that there is glass to glass contact when carrying or transporting the multiple bottles of soft drinks or the like. Consumers generally do not like the sound of glass clinking or banging together, often giving at least some of them an insecure feeling or sensation. This insecurity or annoyance, it is believed, prevents them from purchasing as many glass bottles as they otherwise would.

SUMMARY OF THE INVENTION

According to the practice of this invention a generally conventional paperboard bottle carrier is provided with a downwardly depending divider panel and with a hand or finger receiving opening generally rectangular in configuration, with the longitudinal axis of an oblong opening in the main portion of the flap carrier being generally parallel with the plane of the divider panel. The divider panel extends downwardly from the flat or upper portion of the carrier and extends to a location between adjacent glass bottles of the carrier. The entire construction is formed of a unitary blank of paperboard or other stiff, resilient, and foldable sheet material.

BRIEF DESCRIPTION OF THE DRAWINGS

FIG. 2 is a perspective view illustrating the blank of FIG. 1 folded and glued and ready to receive glass bottles.

FIG. 3 is an end elevational view of the carrier of FIG. 2 with glass bottles inserted into the carrier.

FIG. 5 is view similar to FIG. 2, and illustrates the embodiment formed from the blank of FIG. 4.

FIG. 6 is a view similar to FIG. 3, and illustrates a single glass bottle in the carrier of FIG. 5.

DETAILED DESCRIPTION OF THE INVENTION

Figure 1:
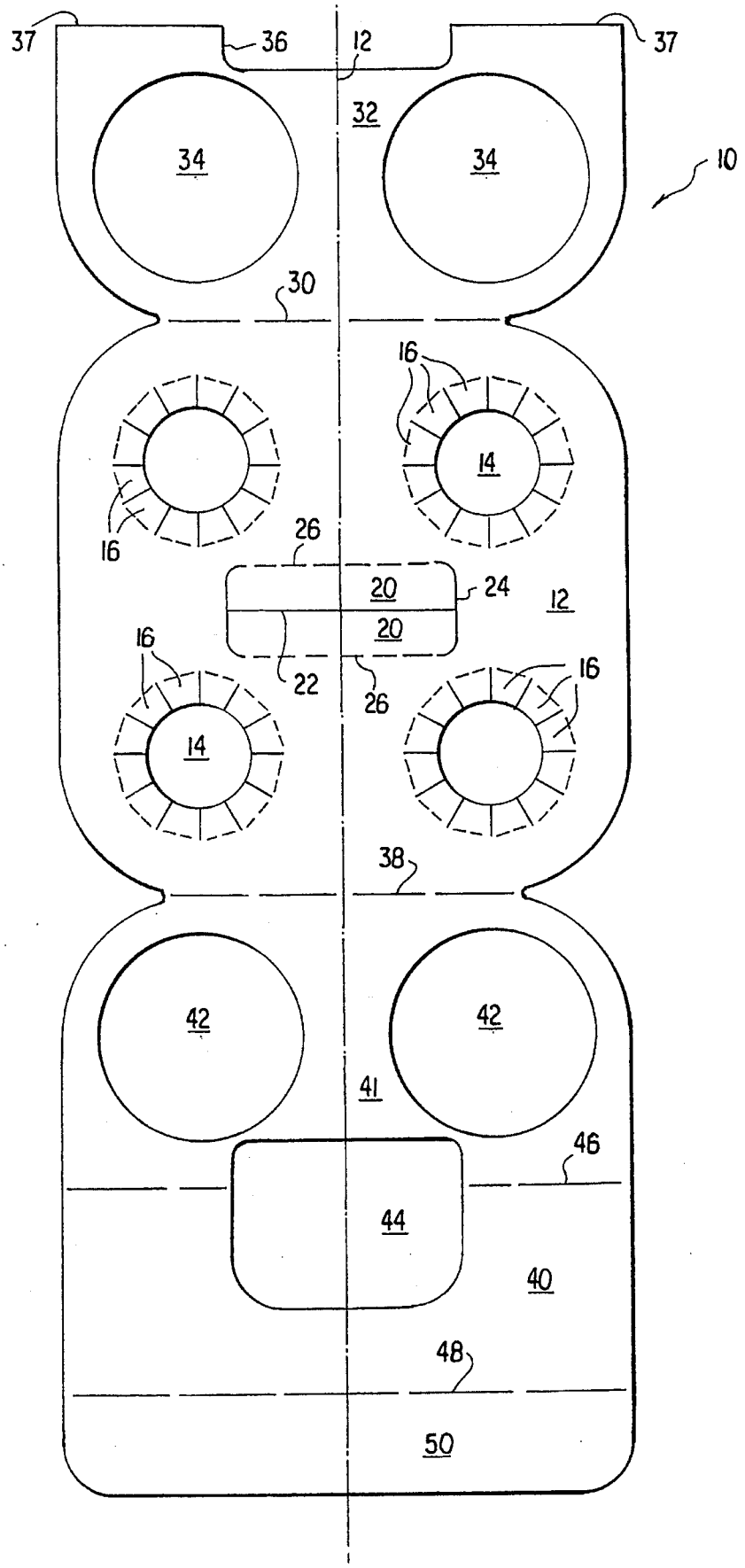
FIG. 1 is a plan view of a unitary blank of paperboard from which the glass bottle carrier of this invention is formed.

Referring now to FIG. 1 of the drawings, a unitary paperboard blank is denoted generally as 10, the blank including a main central or upper panel 12 having a plurality of openings 14 therein. The periphery of each opening 14 is defined by the free ends of resilient fingers 16 defined by the indicated radially extending cut lines extending completely through the paperboard and by the fold lines at their radially outward bases. Two trap door panels 20 are located centrally of panel 12, with panels 20 defined by a single transverse cut line 22 running at right angles to longitudinal axis 12 of blank 10. Fold lines 26 are parallel to and spaced from cut line 22, with other cut lines 24 at the smaller ends of the finger carrying opening defined by folding down or pushing down trap door flaps 20, as will be seen at FIG. 2. The upper portion of panel 12 carries a fold line 30, also transverse to longitudinal axis 12, with panel 32, defining a first reinforcing panel, lying above fold line 30. Openings 34 are located in panel 32 on respective opposite sides of longitudinal axis 12. The uppermost portion of panel 32 is provided with a recess 36, with free edges 37 being spaced from each other by recess or cut-out 36. The axial extent of panel 32 from fold line 30 to free edge 37 is approximately the same as the vertical extent from fold line 30 to cut line 22, so that upon folding panel 32 against the lower surface of main panel 12, panel 32 will occupy approximately half of its area.

A fold line 38 is located at the bottom edge of main panel 12 and secures second reinforcing panel 40 integrally to main panel 12. Panel 41 is provided with openings 42 on respective opposite sides of longitudinal axis 12, with a generally rectangular finger receiving opening 44 located beneath openings 42. Transverse fold lines 46 and 48 are at right angles to axis 12, with the portion of panel 40 beneath fold line 48 designated as 50. Fold line 46 is a central divider fold line. Panel 40 defines a divider panel.

Referring now to FIG. 2 of the drawings, the blank of FIG. 1 has been folded and glued, with second reinforcing panel 32 folded about fold line 30 and glued to the bottom of main panel 12. Divider panel 40 extends vertically downwardly from fold line 46, with lower flap 50 folded about fold line 48 and glued to one side of divider panel 40. Trap door flaps 20 are pushed downwardly and are free to swing to a position below the plane of main panel 12 by virtue of recess 36 and opening 44. It is seen that recess 36, located on a free edge of panel 32, is congruent to the upper half of the main panel finger receiving recess, that is, congruent to upper flap 20.

FIG. 3 illustrates the carrier of FIG. 2 with a plurality of glass bottles 60 carried by the carrier, with the upper portion of each bottle 60 having an integral and annular enlargement 62 on its neck 64, with the neck being provided with screw threads (not illustrated) for receiving screw cap 66. It will be observed that resilient fingers 46 are at approximately 45°–60° to the plane of panel 12. FIGS. 2 and 3 illustrate that the longitudinal axis of the finger opening defined by trap door panels 20 lies in the plane of divider panel 40.

In use, the consumer lifts up the carrier with glass bottles shown at FIG. 3, this lifting causing the bottles 60 to move towards each other. Contact between the glass bottles is presented by flap 50 folded back against divider panel 40, as seen at FIG. 3. As readily visualized from a consideration of FIGS. 2 and 3, openings 42 and 34 are aligned with respective openings 14, with panels 32 and 41 making the container more rigid. The lower portion of opening 44 permits the fingers of the consumer to pass through divider panel 40.

Figure 4:
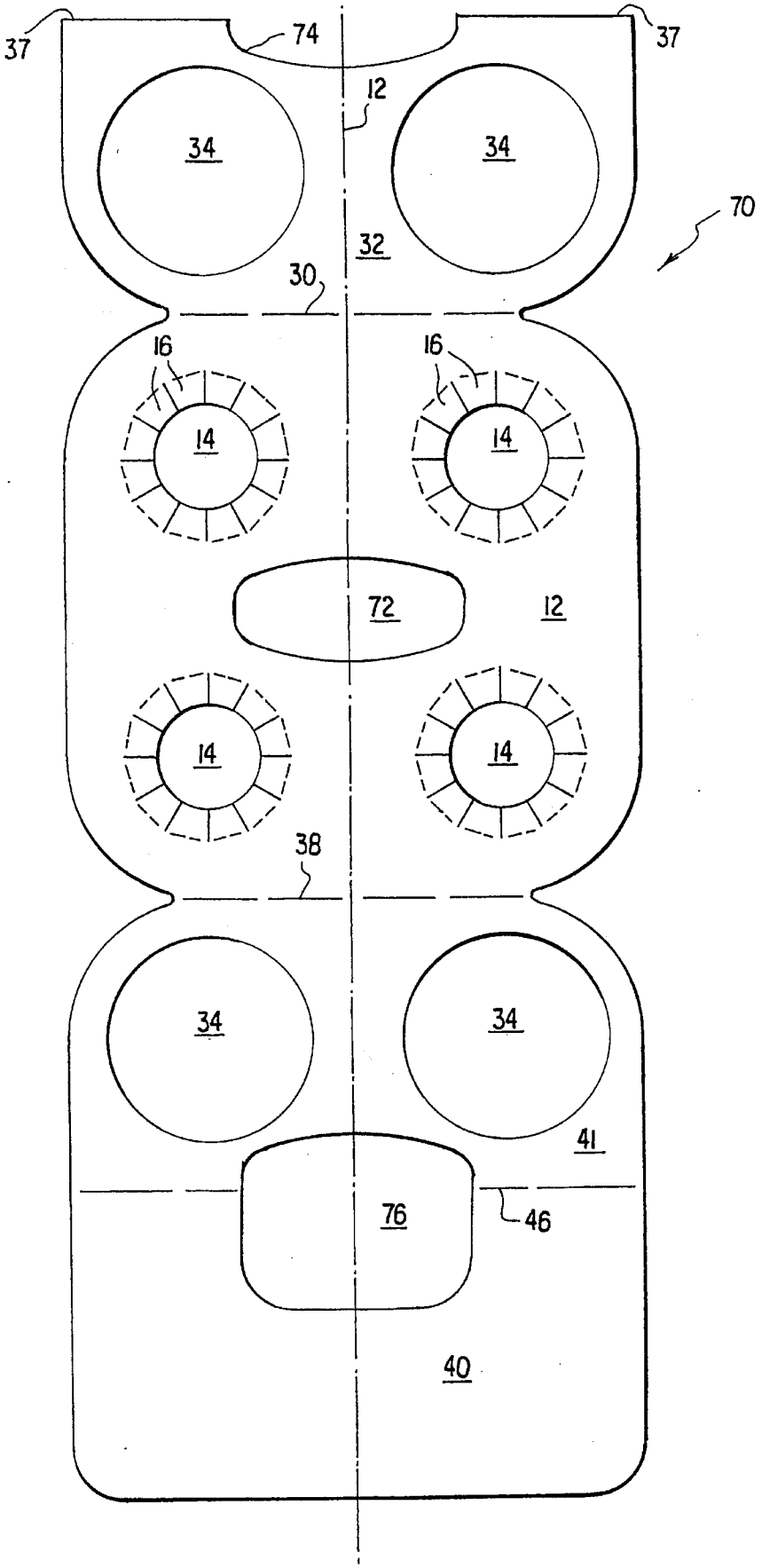
FIG. 4 is a view similar to FIG. 1 and illustrates a second embodiment.

Referring now to FIG. 4 of the drawings, another blank, similar to that of FIG. 1, is illustrated and is denoted generally as 70. Blank 70 also has a longitudinal axis 12, a main panel 12 and upper and lower panels, including a divider panel. The upper edge of upper panel 32 is provided with a recess or cut-out 74, similar in form and function to cut-out 36 of the embodiment of FIG. 1. Similarly, finger engaging opening 72 is similar to that defined by trap door flaps 20 of the embodiment of FIG. 1, it will be observed that the longitudinal axis of finger opening 72 (not illustrated) is at right angles to longitudinal axis 12 and thus parallel to fold line 46. Opening 76 in divider panel 40 is similar in shape and function to opening 44 of FIG. 1.

Referring now to FIG. 5, the blank of FIG. 4 has been folded about fold lines 30, 38 and 46, with reinforcing panels 32 and 41 glued to the underside of main panel 12. Divider panel 40 is seen as extending vertically downward.

In FIG. 6, a glass bottle 60, shown in phantom lines, is illustrated, being of the same construction as that previously shown at FIG. 3. FIG. 6 shows that hand or finger opening 72 is aligned with cut-outs 74 and 76 and to enable the fingers of the consumer to extend down beneath the plane of main panel 12. FIG. 6 illustrates divider panel 40 as touching the upper side of bottle 60, and it will be readily visualized that the same action occurs with another bottle 60 (not shown) on the left.

Figure 7:
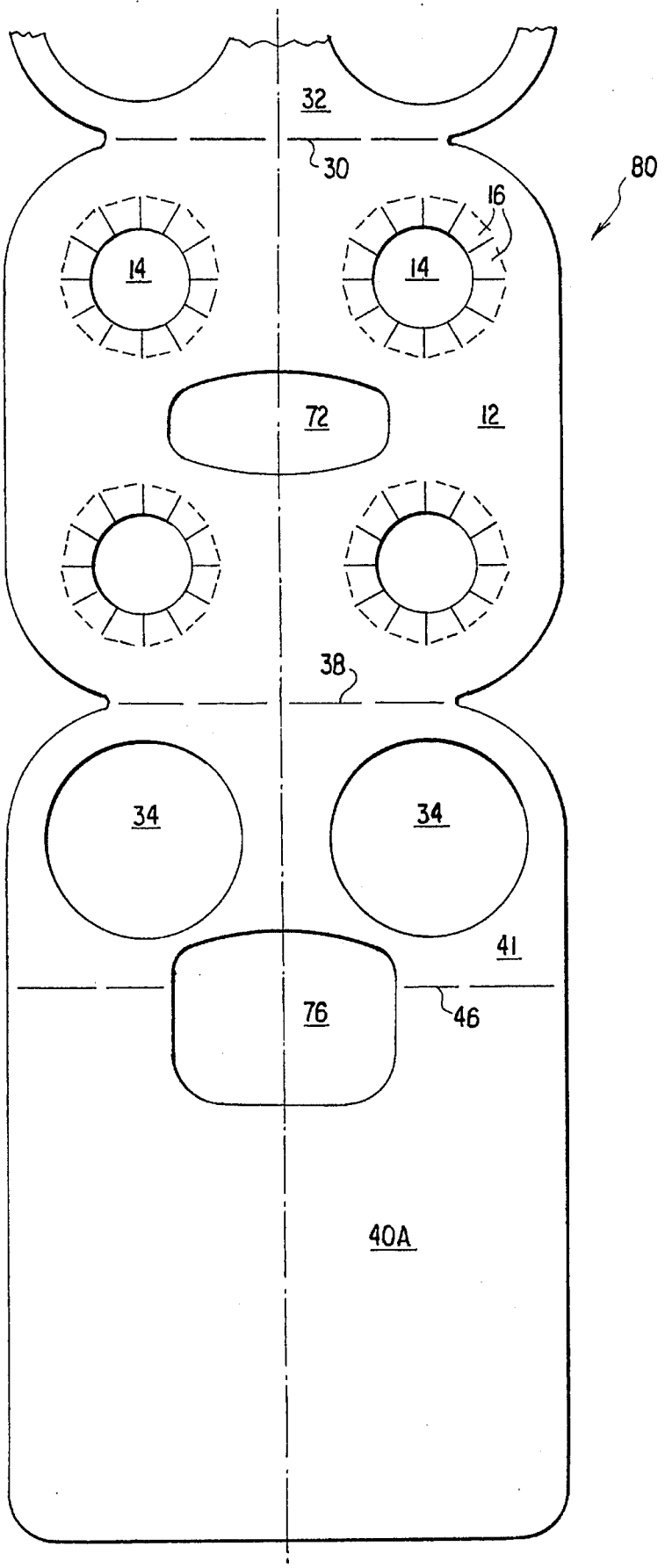
FIG. 7 is a view similar to FIG. 1 and illustrates a third embodiment of the invention.
Figure 8:
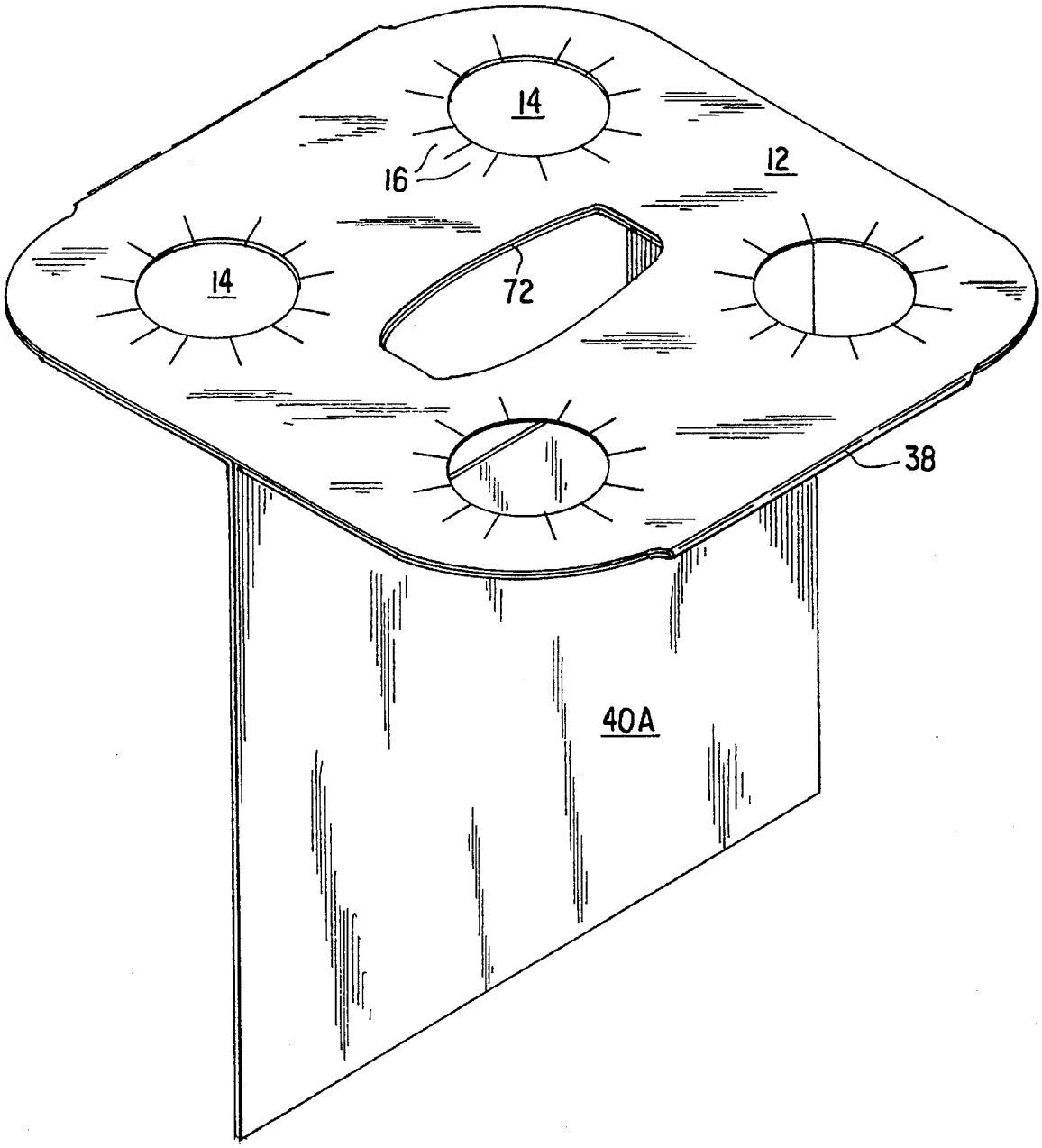
FIG. 8 is a view similar to FIG. 2 and shows the blank of FIG. 7 folded and glued to form a carrier for glass bottles.

Referring now to FIG. 7, a third unitary paper blank, designated as 80, is used to form a third embodiment of the invention. This embodiment differs only from that of FIG. 4 in having a longer divider panel 40, denoted as 40A at FIG. 7. FIG. 8 shows the divider panel 40A extending substantially farther downwardly from that illustrated at FIG. 5. From the above description of the invention, it will be readily visualized that bottles 60 (not shown) are centered into the carrier of FIG. 8, with divider panel 40A separating sides of the bottles. Again, the longitudinal axis of finger hole 72, for carrying the carrier, lies in the plane of divider panel 40A.

We claim:

1. A bottle carrier for carrying glass bottles, said carrier fashioned from a unitary blank of paperboard and having a main panel, said main panel having a plurality of glass bottle receiving openings with each said opening having resilient fingers therearound, said main panel having a human finger receiving opening, said human finger receiving opening having a longitudinal axis, said main panel having a first reinforcing panel foldably secured thereto along one edge of said main panel, said first reinforcing panel having a divider panel foldably secured thereto, said divider panel lying in a plane at right angles to said main panel, said divider panel having a plane which substantially divides said main panel into two identical halves, said main panel finger receiving opening longitudinal axis lying in said plane of said divider panel, said divider panel having a human finger receiving opening in its said plane.

2. The bottle carrier of claim 1 wherein said divider panel has a free end which is folded over and glued to said divider panel.

3. The bottle carrier of claim 1 wherein said first reinforcing panel is folded under and glued to said main panel.

4. The bottle carrier of claim 3 including a second reinforcing panel foldably secured to said main panel at an opposite end of said main panel from said first reinforcing panel, said second reinforcing panel folded under and glued to said main panel.

5. A unitary paperboard blank for forming a bottle carrier, said blank being generally rectangular and having a central, main panel and two ends each of which includes a reinforcing panel to thereby define first and second reinforcing panels, said main panel having a plurality of bottle neck receiving openings and a central, finger receiving opening having a longitudinal axis, said first and second reinforcing panels each joined to opposite ends of said main panel by respective fold lines which are parallel to each other, said first reinforcing panel having a plurality of openings and having a divider panel foldably attached thereto by a divider central fold line, said divider panel aligned with said main panel and said second reinforcing panel and said first reinforcing panel, said divider panel having a human finger receiving opening.

6. The blank of claim 5 wherein said divider panel human finger receiving opening extends into said first reinforcing panel, and wherein said second divider panel has a recess which is congruent to half of said main panel finger receiving opening.

7. The blank of claim 5 wherein said main panel finger opening longitudinal axis is parallel to said divider central fold line.

* * * * *